US006787192B2

(12) United States Patent
Fukumura et al.

(10) Patent No.: US 6,787,192 B2
(45) Date of Patent: Sep. 7, 2004

(54) PROCESS FOR PRODUCING PART MADE OF MAGNESIUM AND/OR MAGNESIUM ALLOY

(75) Inventors: Kazunori Fukumura, Tokushima (JP); Koji Sakane, Osaka (JP)

(73) Assignee: Otsuka Kagaku Kabushiki Kaisha, Osaka (JP)

( * ) Notice: Subject to any disclaimer, the term of this patent is extended or adjusted under 35 U.S.C. 154(b) by 0 days.

(21) Appl. No.: 10/257,164

(22) PCT Filed: Apr. 27, 2001

(86) PCT No.: PCT/JP01/03676

§ 371 (c)(1),
(2), (4) Date: Feb. 6, 2003

(87) PCT Pub. No.: WO01/83849

PCT Pub. Date: Nov. 8, 2001

(65) Prior Publication Data

US 2003/0145908 A1 Aug. 7, 2003

(30) Foreign Application Priority Data

Apr. 27, 2000 (JP) ..... 2000-127517

(51) Int. Cl.[7] ..... B05D 1/36; B05D 7/00; B05D 3/10; B05D 3/02

(52) U.S. Cl. ..... 427/402; 427/327; 427/376.1; 427/337; 427/343; 427/600; 148/275; 148/420

(58) Field of Search ..... 427/402, 327, 427/376.1, 337, 343, 600; 148/275, 420

(56) References Cited

U.S. PATENT DOCUMENTS

| | | | | | |
|---|---|---|---|---|---|
| 3,222,226 | A | | 12/1965 | Maurer et al. | 148/6.16 |
| 3,852,125 | A | * | 12/1974 | Brown | 428/471 |
| 5,226,976 | A | | 7/1993 | Carlson et al. | 148/257 |
| 6,358,616 | B1 | * | 3/2002 | Jennings | 428/450 |
| 6,569,264 | B1 | * | 5/2003 | Fukumura et al. | 148/259 |

FOREIGN PATENT DOCUMENTS

| | | | | |
|---|---|---|---|---|
| DE | 199 13 242 | A1 | | 9/2000 |
| EP | 0 995 785 | A1 | | 4/2000 |
| EP | 1 148 154 | A1 | | 10/2001 |
| GB | 1041347 | | | 9/1966 |
| GB | 2 005 244 | A | | 4/1979 |
| JP | 56-98495 | A | * | 8/1981 |
| JP | 60-33360 | A | | 2/1985 |
| JP | 06-116739 | | | 4/1994 |
| JP | 6-116740 | A | | 4/1994 |
| JP | 10-183372 | A | | 7/1998 |
| WO | 95/02712 | A2 | | 1/1995 |
| WO | 95/12010 | A1 | | 5/1995 |
| WO | 99/47729 | A1 | | 11/1999 |
| WO | WO 00/40777 | | * | 7/2000 |

* cited by examiner

*Primary Examiner*—Michael Barr
(74) *Attorney, Agent, or Firm*—Kubovcik & kubovcik

(57) ABSTRACT

A process for preparing a treated magnesium and/or magnesium alloy component comprising (A) treating the magnesium and/or magnesium alloy component with a surface treating agent containing a phosphate, (B) treating the component with a pre-treating agent used before a corrosion inhibition treatment, (C) treating the component, as required, with a cleaning agent containing surfactant and at least one compound selected from among aromatic carboxylic acids and salts thereof, and thereafter (D) treating the component further as required, with a corrosion inhibitor for magnesium.

28 Claims, No Drawings

PROCESS FOR PRODUCING PART MADE OF MAGNESIUM AND/OR MAGNESIUM ALLOY

This application is the National Stage Application of PCT/JP01/03676 filed Apr. 27, 2001.

TECHNICAL FIELD

The present invention relates to a process for preparing magnesium and/or magnesium alloy component or part.

BACKGROUND ART

Magnesium is the most lightweight of all the metals for use as practically useful structural materials, has a high specific strength, is easy to machine and therefore has found wide use for motor vehicle components, electric products such as computers and acoustic devices, aircraft components, etc. Generally, magnesium and magnesium alloys are made into shaped articles mainly by die casting, extrusion or rolling, while the so-called thixomolding process with use of an injection molding machine has been established technically in recent years. This process assures the freedom of shape of moldings, the productivity thereof and improved properties, rendering the moldings useful for wider application.

Conventionally, castings or molding obtained by die casting or thixomolding are made into magnesium alloy products generally by the following steps.

1. Mechanical Treating Step

Polishing step with use of a polishing belt, abrasive paper or brush or by barrel finishing, buffing, blasting or the like for removing surface roughness or extraneous matter such as burrs, tough oxides, extrusion lubricant, mold releasing agent, casting sand or common soil.

2. Degreasing Step (1) Degreasing with solvent: Preliminary degreasing or cleaning for removing cutting oil, grease or the like with a petroleum, aromatic, hydrocarbon or chlorine solvent.

(2) Degreasing with alkali: Degreasing or cleaning with use of caustic soda or like alkali solution for removing common soil, scorched graphite lubricant or cutting oil, etc.

(3) Degreasing with emulsion: Cleaning for removing soil from the metal surface by emulsification.

3. Pickling Step

The step of cleaning with a solution of single acid such as hydrofluoric acid, nitric acid, sulfuric acid, phosphoric acid or chromic acid or a solution of a mixture of such acids for removing oxide film, corrosion product, scorched lubricant, lodged abrasive agent, shot, casting sand or other soil which remains unremoved by the degreasing step, activating the surface of the casting or molding, or removing segregated layer.

4. Step of Treatment with Chromic Acid

The step of forming a chromate film over the surface of the casting or molding generally with use of a chromic acid agent to give corrosion resistance.

5. Cleaning Step

The step of cleaning with alkali and water or the like for removing the above chromate coating.

6. Drying Step

7. Coating or Plating Step

8. Assembling Step

In the above step 4, magnesium alloy components are generally treated with chromates (for example, JP-B-17911/1986, etc.). The chromate treatment nevertheless involves difficulty in setting the conditions for the treatment, so that it has been desired to provide more convenient corrosion inhibiting processes. Furthermore, the chromate treatment has the drawback that when conducted, the treatment discolors the surface of the metal, depriving the metal of its luster. In view of recent environmental protection, chrome compound is restricted or prohibited in use and processes are more desirable which are less likely to burden the environment.

Some of treating methods are proposed as a substitute for chromate treatment. For example, proposed are method using potassium permanganate under alkaline condition and method using manganese phosphate under acid condition. However, although these methods obtain corrosion effect by coating manganese on magnesium surface, insufficient effect is achieved.

An object of the present invention is to provide a process for preparing magnesium and/or magnesium alloy component which is excellent in corrosion resistance, coating adhesiveness and property of shielding electromagnetic waves.

DISCLOSURE OF THE INVENTION (1) The present invention provides a process for preparing a treated magnesium and/or magnesium alloy component comprising (A) treating the magnesium and/or magnesium alloy component with a surface treating agent containing a phosphate, and thereafter (B) treating the component with a pre-treating agent used before a corrosion inhibition treatment.

(2) The present invention provides a process for preparing a treated magnesium and/or magnesium alloy component comprising (A) treating the magnesium and/or magnesium alloy component with a surface treating agent containing a phosphate, (B) treating the component with a pre-treating agent used before a corrosion inhibition treatment, and thereafter (D) treating the component with a corrosion inhibitor for magnesium.

(3) The present invention provides a process for preparing a treated magnesium and/or magnesium alloy component comprising (A) treating the magnesium and/or magnesium alloy component with a surface treating agent containing a phosphate, (B) treating the component with a pre-treating agent used before a corrosion inhibition treatment, (C) treating the component with a cleaning agent containing surfactant and at least one compound selected from among aromatic carboxylic acids and salts thereof, and thereafter (D) treating the component with a corrosion inhibitor for magnesium.

(4) The present invention provides a process as defined in the above (1) to (3) wherein as the treating agent (A) is used an agent containing a phosphate and at least one compound selected from among aromatic carboxylic acids and salts thereof, and further as required at least one compound selected from among pyrazole compounds and triazole compounds.

(5) The present invention provides a process as defined in the above (1) to (4) wherein as the treating agent (D) is used an agent containing at least one compound selected from among aromatic carboxylic acids and salts thereof, and further as required at least one compound selected from among pyrazole compounds and triazole compounds.

(6) The present invention provides a process as defined in the above (1) to (5) wherein at least one step of (A), (B), (C) and (D) is conducted under ultrasonic wave.

(7) The present invention provides a process as defined in the above (1) to (6) wherein washing with water is added in a next step of each of at least one step of (A), (B), (C) and (D).

Further, the present invention provides a process for preparing a treated magnesium and/or magnesium alloy component comprising (1) deburring the magnesium and/or magnesium alloy component when required, (2) treating the component with a surface treating agent containing a phosphate, (3) treating the component with a pre-treating agent used before a corrosion inhibition treatment, (4) treating the component with a corrosion inhibitor for magnesium, (5) drying the component, (6) coating or plating the component, and (7) thereafter assembling the component.

The present inventors have investigated various substitutes for chromate treating agent. During the investigation, it is revealed that a treatment prior to corrosion inhibitory step is one of factors which contribute to improvement in corrosion resistance, coating adhesiveness and property of shielding electromagnetic waves.

The present inventors have proposed in PCT/JP00/00019 a surface treating agent which is useful for moldings of magnesium and/or magnesium alloys and contains a phosphate and at least one compound selected from among aromatic carboxylic acids and salts thereof. The present inventors have further investigated to obtain more excellent corrosion resistance, coating adhesiveness and property of shielding electromagnetic waves using the above surface treating agent. As the result, it is found that effects in corrosion, coating and plating are greatly enhanced by using a pre-treating agent for corrosion inhibition after treating moldings of magnesium and/or magnesium alloys with a surface treating agent containing a phosphate, or at least one compound selected from among aromatic carboxylic acids and salts thereof together with the phosphate. The present invention has been accomplished by this finding. The similar effect was obtained by use of the above phosphate, at least one compound selected from among aromatic carboxylic acids and salts thereof, and at least one compound selected from among pyrazole compounds and triazole compounds.

The present surface treating agent contains a phosphate.

Examples of phosphates are ammonium salts and alkanolamine salts of orthophosphoric acid, condensed phosphoric acids or like phosphoric acids.

Examples of condensed phosphoric acids are metaphosphoric acids and polyphosphoric acids. Examples of metaphosphoric acids are trimetaphosphoric acid, tetrametaphosphoric acid, etc. Examples of polyphosphoric acids are pyrophosphoric acid, triphosphoric acid, tetraphosphoric acid and the like.

More specific examples of phosphates are ammonium primary phosphate, ammonium secondary phosphate, ammonium tertiary phosphate, monoethanolamine salt of phosphoric acid, diethanolamine salt of phosphoric acid, triethanolamine salt of phosphoric acid, isopropanolamine salt of phosphoric acid, ammonium salt of trimetaphosphoric acid, ammonium salt of tetrametaphosphoric acid, ethanolamine salt of tetrametaphosphoric acid, ammonium salt of triphosphoric acid, ammonium salt of tetraphosphoric acid, etc. These phosphates can be used singly, or at least two of them are usable in combination.

Among these, ammonium salts and alkanolamine salts of phosphoric acids are desirable since they have a suitable etching effect and are less likely to produce smut after cleaning. More desirable are ammonium salts of condensed phosphoric acids because they have high safety, permit facilitated waste water disposal, are capable of readily etching the surface of magnesium and/or magnesium alloy and are unlikely to etch to excess.

The ammonium salts of condensed phosphoric acids are known. Such a salt can be obtained, for example, by heating orthophosphoric acid (normal phosphoric acid) and urea for condensation. In this case, the reaction is conducted preferably under such a condition that the molar ratio of orthophosphoric acid to urea is 1:0.5 to 1:5. The surface treating agent may contain the unreacted materials in the reaction mixture, i.e., orthophosphoric acid and urea, and is usable without giving any problem to the advantage of the invention.

In case of treating the surface of magnesium and/or magnesium alloy component with the present surface treating agent, the phosphate is used usually in an amount of about 0.001 to about 90 wt. %, preferably about 0.5 to about 50 wt. %, more preferably about 1 to about 40 wt %. If the amount is greater than 50 wt. %, the surface of magnesium becomes colored black after cleaning, whereas if the amount is less than 0.5 wt. %, insufficient etching will result, failing to produce a full degreasing effect.

However, in case of the amount of the phosphate is less than 0.5 wt. % and relatively insufficient in etching effect and degreasing effect, when the treatment with the pre-treating agent used before a corrosion inhibition treatment is conducted in a next step, these defects can be remedied. Furthermore, in case of the amount of the phosphate is greater than 50 wt. % and the surface of magnesium becomes colored black, when the treatment with the pre-treating agent used before a corrosion inhibition treatment is conducted in a next step, these defects can be removed.

In the present invention, it is possible to use a surface treating agent having such a wide range of phosphate concentration. When using a phosphate of low concentration, it leads low cost, mild surface treatment, minute surface, and easy control of the condition of treatment. When using a phosphate of high concentration, it brings short treatment time, and enhancement in corrosion resistance, coating adhesiveness and property in shielding electromagnetic waves.

It is usual phenomenon in magnesium that the surface of magnesium becomes colored black, when the amount of the phosphate is greater than 50 wt. %. Further, when the present process is applied to a metal such as aluminum or zinc, sufficient effect is not obtained.

In the present invention, as the surface treating agent, it is possible to use an agent containing the above phosphate and at least one compound selected from among aromatic carboxylic acids and salts thereof, and further as required at least one compound selected from among pyrazole compounds and triazole compounds.

The aromatic carboxylic acid to be used is preferably a compound of the formula (1) which is substituted with $R^1$ at the first position of its benzene ring and with $R^2$, $R^3$ or $R^4$ at any one of the 2- to 6-positions of the ring, or a compound of the formula (2) which is substituted with $R^1$ at the first position of its naphthalene ring, with $R^8$ at the 8-position of the ring and with $R^2$, $R^3$, $R^4$, $R^5$, $R^6$ or $R^7$ at any one of the 2- to 7-positions.

(1)

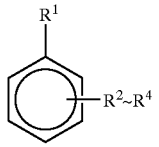

(2)

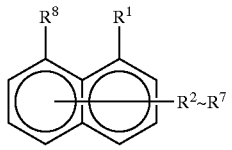

wherein $R^1$ is carboxyl, carboxymethyl or carboxyvinyl, $R^2$, $R^3$, $R^4$, $R^5$, $R^6$ and $R^7$ are the same or different and are each a hydrogen atom, $C_1$ to $C_8$ alkyl, nitro, a halogen atom or amino, and $R^8$ is a hydrogen atom, carboxyl, carboxymethyl or carboxyvinyl.

Specific examples of such carboxylic acids are benzoic acid, cuminic acid, o-cuminic acid, m-cuminic acid, p-tert-butylbenzoic acid, m-toluic acid, o-toluic acid, p-toluic acid, hydroxytoluic acid, mononitrobenzoic acid, dinitrobenzoic acid, nitrotoluic acid, nitrophthalic acid, chlorobenzoic acid, p-nitrophenylacetic acid, nitrocinnamic acid, naphthoic acid, 2-hydroxynaphthoic acid, naphthalic acid, etc.

Usable as salts of these acids are salts of such acids with various organic bases and inorganic bases. Examples of organic bases are monoethanolamine, diethanolamine, triethanolamine, monoisopropanolamine, diisopropanolamine, triisopropanolamine and like alkanolamines, methylamine, ethylamine, cyclohexylamine and like aliphatic amines, 1,3-bis(aminomethyl) cyclohexane (1,3-BAMCH), ethylenediamine and like aliphatic diamines, TMAH(tetramethylammonium hydroxide), tetraethylammonium hydroxide, tetramethylammonium nitrate and like ammonium salts, DBU(1,8-diazabicyclo[5.4.0]-7-undecene), DBN(1,5-diazabicyclo[4.3.0]-5-nonene), 1-aminopyrrolidine, morpholine and like cyclic amines. Examples of inorganic bases are ammonia, hydrazine, sodium hydroxide, potassium hydroxide and like alkali metal hydroxides. One of such salts is usable singly, or at least two of them are usable at the same time. These salts are more soluble in water, have a higher corrosion inhibitory effect and are therefore more preferable than aromatic carboxylic acids used as such without conversion to salts.

Among these salts, alkanolamine and aliphatic diamine and like organic amine salts, ammonia salts and hydrazine salts are especially preferred because crystals will not adhere to the surface of the article treated with use of such a salt and further because these salts give satisfactory surface properties.

Examples of especially preferable aromatic carboxylic acids and salts thereof for use in the present invention are cuminic acid, o-cuminic acid, m-cuminic acid, p-tert-butylbenzoic acid, m-toluic acid, o-toluic acid, p-toluic acid, and alkanolamine salts of these acids.

It is desirable to use a pyrazole compound or triazole compound in combination with the aromatic carboxylic acid from the viewpoint of giving an improved corrosion inhibiting property. Specific examples of useful pyrazole compounds are pyrazole, 3,5-dimethylpyrazole, 3-methyl-5-hydroxypyrazole, 4-aminopyrazole, etc. Examples of such triazole compounds are 1,2,3-triazole, 1,2,4-triazole, benzotriazole and like triazole compounds, and triazole derivatives comprising such a triazole compound substituted with $C_1$ to $C_8$ alkyl, mercapto, hydroxyl or the like at a desired position.

More specific examples of such triazole compounds are 1,2,3-triazole, 1,2,4-triazole, 3-mercapto-1,2,4-triazole, 3-hydroxy-1,2,4-triazole, 3-methyl-1,2,4-triazole, 1-methyl-1,2,4-triazole, 1-methyl-3-mercapto-1,2,4-triazole, 4-methyl-1,2,3-triazole, benzotriazole, 1-hydroxybenzotriazole, etc. Especially preferable among these are 1,2,3-triazole, 1,2,4-triazole, benzotriazole, 3-mercapto-1,2,4-triazole and 3-hydroxy-1,2,4-triazole, and more preferable are 1,2,3-triazole, 1,2,4-triazole and 3-mercapto-1,2,4-triazole. These pyrazole compounds or triazole compounds are usable singly, or at least two of them can be used at the same time.

Examples of the pre-treating agent used before a corrosion inhibition treatment are alkanolamines such as monoethanolamine, diethanolamine, triethanolamine, monoisopropanolamine, diisopropanolamine and triisopropanolamine; aliphatic amines such as methylamine, ethylamine and cyclohexylamine; aliphatic diamines such as 1,3-BAMCH and ethylenediamine; ammonium salts such as TMAH, tetraethylammonium hydroxide and tetramethylammonium nitrate; and cyclic amines such as DBU, DBN, 1-aminopyrrolidine, morpholine, ammonia, hydrazine, alkali metal hydroxides such as sodium hydroxide and potassium hydroxide and alkali metal salts of silicic acid such as sodium orthosilicate, potassium orthosilicate, sodium metasilicate and potassium metasilicate. These pre-treating agents can be used singly or in combination of at least two of them at the same time. Among these particularly preferable are alkali metal hydroxides such as sodium hydroxide and potassium hydroxide and ammonium salts such as TMAH.

The concentration of the pre-treating agent is about 1 to about 50 wt. %, preferably about 5 to about 35 wt. %. The pre-treating agent is an agent used before a corrosion inhibition treatment, and can be applied by spraying, coating with a spray or roll coater or impregnation with use of a treating bath.

As the present corrosion inhibitor for magnesium are usable chromic acid, dichromate, manganese phosphate, potassium permanganate, improved chromic acid, ferric nitrate, stannic acid, zirconium phosphate, stannous chloride, and a corrosion inhibitor for magnesium or magnesium alloys which contains at least one compound selected from among aromatic carboxylic acids and salts thereof and is proposed by the present inventors in PCT/JP00/00019. In view of non-chromate, preferable are manganese phosphate, potassium permanganate, ferric nitrate, stannic acid, zirconium phosphate, stannous chloride, and a corrosion inhibitor for magnesium or magnesium alloys which contains at least one compound selected from among aromatic carboxylic acids and salts thereof. In case of using aromatic carboxylic acids and salts thereof, the concentration is suitably selected but is usually about 0.01 to about 30 wt. %, preferably about 0.1 to about 10 wt. % in total amount. Further, it is possible to use conjointly at least one compound selected from among the above pyrazole compounds and triazole compounds. In case of using the pyrazole compound or triazole compound, the concentration in the treating agent is about 0.01 to about 30 wt. %, preferably about 0.1 to about 10 wt. %. The ratio by weight of the aromatic carboxylic acids and salts thereof to the pyrazole compound or triazole compound can be, for example, 10:1 to 1:10.

Further, as the cleaning agent of the present invention is usable one containing a surfactant and at least one compound selected from among the above aromatic carboxylic acids and salts thereof. To the cleaning agent can be added at least one compound selected from among the above pyrazole compounds and triazole compounds.

Known surfactants can be used. Nonionic and amphoteric surfactants are preferably used, and anionic and cationic surfactants are also usable.

Nonionic surfactant is not specifically limited and includes for example polyoxyethylene alkyl ethers such as polyoxyethylene lauryl ether and polyoxyethylene higher alcohol ether, polyoxyethylene alkylphenyl ethers such as polyoxyethylene octylphenyl ether, polyoxyethylene glycol fatty acid esters such as polyoxyethylene monostearate, sorbitan fatty acid esters such as sorbitan monolaurate and polyoxyethylene sorbitan monolaurate, glycol fatty acid esters such as glycol monostearate and fatty acid monoglyceride. Among these preferable are polyoxyethylene alkyl ethers and polyoxyethylene alkylphenyl ethers, and particularly preferable are those having HLB value of 13 to 15.

Amphoteric surfactant is not specifically limited and includes for example aminocarboxylic acids such as alkyl β-aminopropionic acids, alkyl β-iminodipropionic acids and β-aminopropionic acid, and betaines such as trimethylglycine. Among these preferable are β-aminopropionic acid and betaines.

Anionic surfactant is not also specifically limited and includes for example fatty acid salt, alkyl sulfate salt, alkyl sulfonate salt, alkyl arylsulfonate salt, alkyl naphthalene sulfonate salt, alkyl sulfosuccinate salt, alkyl diphenyl ether disulfonate salt, alkyl phosphate salt, polyoxyethylene alkyl sulfonate salt and sulfosuccinate salt. Among these preferable are fatty acid salts and alkyl sulfosuccinate salts.

Cationic surfactant is not also specifically limited and includes for example aliphatic amine hydrohalides, alkyl pyridinium halides and quaternary ammonium salts. Among these preferable are aliphatic amine hydrohalides and quaternary ammonium salts.

The above surfactant can be used singly or in combination of at least two of them at the same time. The amount of the surfactant can be used singly or in combination of at least two of them at the same time., The amount of the surfactant is usually about 0.001 to about 50 wt. %, preferably about 0.01 to about 10 wt. % in the total of the composition.

Although the surface treating agent, pre-treating agent used prior to a corrosion inhibition treatment step, cleaning agent and corrosion inhibitor of the present invention can be used as it is or as dissolved in a suitable solvent, it is desirable to use each component in the form of an aqueous solution.

The concentration of the aromatic carboxylic acids and salts thereof in the surface treating agent and the cleaning agent is suitably selected but is usually about 0.01 to about 30 wt. %, preferably about 0.1 to about 10 wt. % in total amount.

Further, in case of using the pyrazole compound or triazole compound in the surface treating agent and the cleaning agent, the concentration of the pyrazole compound or triazole compound in the treating agent is about 0.01 to about 30 wt. %, preferably about 0.1 to about 10 wt. %. The ratio by weight of the aromatic carboxylic acids and salts thereof to the pyrazole compound or triazole compound can be, for example, 10:1 to 1:10. Althoug the higher the content of these compounds, the more the corrosion effect is expected, if much higher than 30 wt. %, coating tends to become low in adhesive ability.

Various additives, such as surfactants, chelate agents and defoaming agents, can be incorporated into the surface treating agent, pre-treating agent, cleaning agent and corrosion inhibitor of the present invention.

The present surface treating agent, pre-treating agent, cleaning agent and corrosion inhibitor can be used as it is, it is also possible to use as diluted or concentrated in any concentration.

The present surface treating agent, pre-treating agent used before a corrosion inhibition treatment, cleaning agent and corrosion inhibitor can be applied to an activated surfaces of shaped articles prepared as by thixomolding or die casting, for example, by spraying, coating with a spray or roll coater, or impregnation with use of a treating bath.

The magnesium or magnesium alloy for which the corrosion inhibitor composition of the present invention is usable is not limited specifically. The composition is usable for magnesium as a single metal and a wide variety of alloys or composite materials comprising magnesium and other metals. Examples of other metals are aluminum, zinc, manganese, iron, nickel, copper, lead, tin and calcium. One or at least two metals can be selected from among these metals for use.

It is possible to insert pickling step between the treatment with the surface treating agent and the treatment with the pre-treating agent used before a corrosion inhibition treatment. The chemicals used for pickling step are those used in the conventional pickling of magnesium alloys. Specific examples of chemicals are aqueous solutions of nitric acid-sulfuric acid, phosphoric acid, sulfuric acid, chromic acid-nitric acid-hydrofluoric acid, chromic acid, ferric nitrate, hydrofluoric acid, nitric acid, acetic acid-sodium nitrate, chromic acid-sodium nitrate and chromic acid-sulfuric acid.

Further, prior to the treatment with the surface treating agent, it is possible to conduct the mechanical treatment or degreasing treatment of shaped articles prepared as by thixomolding or die casting. The mechanical treatment includes removing burrs and various soil, and various polishing steps. Barrel finishing, one of polishing, includes for example magnetic barrel finishing by which surface roughness is reduced and fraction defective is decreased even in case of coating of handy phone and the like in which thin coating layer is provided.

As mentioned before, the degreasing treatment steps include degreasing treatments with solvent, alkali and emulsion. These degreasing treatments can be used singly or in combination.

The contemplated product of the present invention can be produced by subjecting the molded articles to treatment with the pre-treating agent used before a corrosion inhibition treatment, treatment with corrosion inhibitor, electrochemical treatment or underplating treatment, as required coating, and thereafter assembling of the articles.

In case of conducting at least one steps of (A), (B), (C) and (D) under ultrasonic waves, it is possible to use a treating bath equipped with a ultrasonic wave generator. Such a treatment under ultrasonic waves can shorten a treatment time and when a large quantity of articles are treated, uniform quality (excellent stability) is obtained in corrosion resistance, coating adhesiveness, electromagnetic wave shielding.

It is further possible to add a step of washing with water, to next step(s) of at least one each step of the above (A), (B), (C) and (D). A solution containing a suitable corrosion inhibitor can be used in washing with water. After washing with water or cleaning with a solution containing a suitable corrosion inhibitor, drying is preferably conducted.

When degreasing with alkali is indicated by (E), pickling treatment by (F), corrosion treatment by (D), treatment with surface treating agent by (A), treatment with pre-treating agent by (B) and treatment with cleaning agent by (C), conventional usual production of magnesium and/or magnesium alloy components comprises steps (E)→(F)→(D), and coating and assembling steps.

Specific examples of embodiments of the present invention are;

1. (A)→(B)→(D)
2. (A)→(B)→(C)→(D)
3. (A)→(F)→(B)→(D)
4. (A)→(F)→(B)→(C)→(D)
5. (E)→(A)→(B)→(D)
6. (E)→(A)→(B)→(C)→(D)
7. (E)→(A)→(F)→(B)→(D)
8. (E)→(A)→(F)→(B)→(C)→(D)

BEST MODE OF CARRYING OUT THE INVENTION

Although the invention will be described below with reference to examples and comparative examples, the invention is not limited to the examples. The parts are by weight.

REFERENCE EXAMPLE 1

Preparation of Surface Treating Agent (1)

Ammonium salt of condensed phosphoric acid was obtained by mixing together orthophosphoric acid and urea in a molar ratio of 1:2 and reacting the mixture for condensation at 150 to 160° C. for 2 hours, and contained unreacted urea and orthophosphoric acid. To the condensed ammonium phosphate was added deionized water to prepare 55% (w/w) aqueous solution of condensed ammonium phosphate. The same condensed ammonium phosphate as above was used in Examples and Comparative Examples to follow.

Into deionized water were placed 5 parts of 55% (w/w) aqueous solution of condensed ammonium phosphate, 5 parts of p-tert-butylbenzoic acid, 1 part of 1,2,4-triazole, 5 parts of diethanolamine, 5 parts of Laol XA60/50 (Lion Corporation, nonionic surfactant), 2.5 parts of Pionin C (Takemoto oil & fat Co., Ltd, amphoteric surfactant) and 0.5 part of Tetoronic TR 913R (Asahi Denka Kogyo K.K., defoaming agent) and dissolved therein to obtain 100 parts of an aqueous solution. The solution was diluted five times to prepare a surface treating agent (1).

REFERENCE EXAMPLE 2

Preparation of Surface Treating Agent (2)

Into deionized water were placed 10 parts of 55% (w/w) aqueous solution of condensed ammonium phosphate, 5 parts of p-tert-butylbenzoic acid, 5 parts of 3-mercapto-1,2,4-triazole, 5 parts of isopropanolamine, 2.5 parts of Laol XA60/50 and dissolved therein to obtain 100 parts of an aqueous solution. The solution was diluted five times to prepare a surface treating agent (2).

REFERENCE EXAMPLE 3

Preparation of Surface Treating Agent (3)

Into deionized water were placed 10 parts of 55% (w/w) aqueous solution of condensed ammonium phosphate, 2.5 parts of Laol XA60/50 and dissolved therein to obtain 100 parts of an aqueous solution. The solution was diluted 500 times to prepare a surface treating agent (3).

REFERENCE EXAMPLE 4

Preparation of Surface Treating Agent (4)

To 100 parts of 55% (w/w) aqueous solution of condensed ammonium phosphate was added 10 parts of Laol XA60/50 to obtain a surface treating agent (4).

REFERENCE EXAMPLE 5

Preparation of Surface Treating Agent (5)

55% (w/w) Aqueous solution (100 parts) of condensed ammonium phosphate was diluted 2.5 times to prepare a surface treating agent (5).

REFERENCE EXAMPLE 6

Preparation of Corrosion Inhibitor (1)

Into deionized water were placed 1.5 parts of m-toluic acid, 1.5 parts of 3-mercapto-1,2,4-triazole, 1.5 parts of isopropanolamine and dissolved therein to obtain 100 parts of a corrosion inhibitor (1).

REFERENCE EXAMPLE 7

Preparation of Corrosion Inhibitor (2)

Into deionized water were placed 5 parts of p-tert-butylbenzoic acid, 5 parts of 3-mercapto-1,2,4-triazole, 5 parts of isopropanolamine and dissolved therein to obtain 100 parts of a solution. The solution was diluted ten times with deionized water to obtain a corrosion inhibitor (2).

REFERENCE EXAMPLE 8

Preparation of Corrosion Inhibitor (3)

Into deionized water were placed 5 parts of m-toluic acid, 5 parts of 3-mercapto-1,2,4-triazole, 5 parts of 1,3-bis (aminomethyl)cyclohexane and dissolved therein to obtain 100 parts of a solution. The solution was diluted ten times with deionized water to obtain a corrosion inhibitor (3).

REFERENCE EXAMPLE 9

Preparation of Cleaning Agent (1)

Into deionized water were placed 5 parts of p-tert-butylbenzoic acid, 1 part of 1,2,4-triazole, 5 parts of diethanolamine, 5 parts of Laol XA60/50, 2.5 parts of Pionin C and 0.5 part of Tetoronic TR 913R and dissolved therein to obtain 100 parts of an aqueous solution. The solution was diluted five times to prepare a cleaning agent (1). cl

EXAMPLE 1

As the test pieces were used molded plates (10×15×0.2 cm) prepared from magnesium alloy AZ91D (containing 90% of magnesium, 9% of aluminum and 1% of zinc) using a die casting machine (product of Toshiba)wherein the die was coated with a release agent (Caster Ace 225, product of Nichibei Co., Ltd.). The same test pieces as above was used in Examples to follow.

Molded plates were immersed in the surface treating agent (1) of Reference Example 1 at 40° C. for 10 minutes and then washed with deionized water for 1 minute. The plates were then immersed in 10% (w/v) aqueous potassium hydroxide serving as a pre-treating agent used before a corrosion inhibition treatment at 60° C. for 15 minutes and then washed with deionized water for 1 minute (hereinafter refer to "Step-1"). Thereafter, the plates were dipped in 1 L of an aqueous solution of manganese phosphate containing 100 g of ammonium dihydrogenphosphate and 20 g of potassium permanganate and adjusted to a pH of 3.5 with orthophosphoric acid at 40° C. for 15 minutes (hereinafter refer to "Manganese-treatment"). The plates were washed with water and dried to obtain test pieces (1).

EXAMPLE 2

After the molded plates were subjected to Step-1, the plates were immersed in the cleaning agent (1) of Reference Example 9 at 50° C. for 15 minutes and then washed with water. The plates were then immersed in corrosion inhibitor (1) of Reference Example 6 at room temperature for 1 minute and dried to obtain test pieces (2).

EXAMPLE 3

The test pieces (1) of Example 1 were immersed in corrosion inhibitor (1) of Reference Example 6 at room temperature for 1 minute and dried to obtain test pieces (3).

EXAMPLE 4

Molded plates were immersed in the surface treating agent (1) of Reference Example 1 at 40° C. for 10 minutes and then washed with deionized water for 1 minute. The plates were then immersed in 5% (w/v) aqueous phosphoric acid solution at room temperature for 0.5 minute and then washed with deionized water for 1 minute. The plates were then immersed in 10% (w/v) aqueous potassium hydroxide solution serving as a pre-treating agent used before a corrosion inhibition treatment at 60° C. for 15 minutes and then washed with deionized water for 1 minute (hereinafter refer to "Step-2"). Thereafter, the plates were subjected to Manganese-treatment. The plates were washed with water and dried to obtain test pieces (4).

EXAMPLE 5

After the molded plates were subjected to Step-2, the plates were immersed in the cleaning agent (1) of Reference Example 9 at 50° C. for 15 minutes and then washed with water. The plates were then immersed in corrosion inhibitor (1) of Reference Example 6 at room temperature for 1 minute and dried to obtain test pieces (5).

EXAMPLE 6

The test pieces (4) of Example 4 were immersed in corrosion inhibitor (1) of Reference Example 6 at room temperature for 1 minute and dried to obtain test pieces (6).

EXAMPLE 7

Molded plates were immersed in 5% (w/v) aqueous sodium monohydrogenphosphate solution at 50 to 70° C. for 5 minutes and then washed with water for 1 minute. The plates were immersed in the surface treating agent (1) of Reference Example 1 at 40° C. for 10 minutes and then washed with deionized water for 1 minute. The plates were then immersed in 10% (w/v) aqueous potassium hydroxide solution serving as a pre-treating agent used before a corrosion inhibition treatment at 60° C. for 15 minutes and then washed with deionized water for 1 minute (hereinafter refer to "Step-3"). Thereafter, the plates were subjected to Manganese-treatment. The plates were washed with water and dried to obtain test pieces (7).

EXAMPLE 8

After the molded plates were subjected to Step-3, the plates were immersed in the cleaning agent (1) of Reference Example 9 at 50° C. for 15 minutes and then washed with water. The plates were then immersed in corrosion inhibitor (1) of Reference Example 6 at room temperature for 1 minute and dried to obtain test pieces (8).

EXAMPLE 9

The test pieces (7) of Example 7 were immersed in corrosion inhibitor (1) of Reference Example 6 at room temperature for 1 minute and dried to obtain test pieces (9).

EXAMPLE 10

Molded plates were immersed in the surface treating agent (2) of Reference Example 2 at 40° C. for 1 minute under ultrasonic waves and then washed with deionized water for 1 minute. The plates were then immersed in 10% (w/v) aqueous potassium hydroxide solution serving as a pre-treating agent used before a corrosion inhibition treatment at 60° C. for 5 minutes under ultrasonic waves and then washed with deionized water for 1 minute. Thereafter, the plates were immersed in corrosion inhibitor (2) of Reference Example 7 at 40° C. for 1 minute under ultrasonic waves and dried to obtain test pieces (10).

Ultrasonic waves were generated by ultrasonic cleaner (product of Kaijo Co., Ltd., C-6356 N, generator 26 kHz in frequency, 600 W). The ultrasonic waves were generated in the same manner in the following.

EXAMPLE 11

Molded plates were immersed in the surface treating agent (3) of Reference Example 3 at 40° C. for 30 minutes under ultrasonic waves and then washed with deionized water for 1 minute. The plates were then immersed in 10% (w/v) aqueous potassium hydroxide solution at 60° C. for 5 minutes under ultrasonic waves and then washed with deionized water for 1 minute. Thereafter, the plates were immersed in corrosion inhibitor (2) of Reference Example 7 at 40° C. for 1 minute under ultrasonic waves and dried to obtain test pieces (11).

EXAMPLE 12

Molded plates were immersed in the surface treating agent (4) of Reference Example 4 at 40° C. for 1 minute under ultrasonic waves and then washed with deionized water for 1 minute. The plates were then immersed in 10% (w/v) aqueous potassium hydroxide solution at 60° C. for 5 minutes under ultrasonic waves and then washed with deionized water for 1 minute. Thereafter, the plates were immersed in corrosion inhibitor (2) of Reference Example 7 at 40° C. for 1 minute under ultrasonic waves and dried to obtain test pieces (12).

EXAMPLE 13

Molded plates were immersed in the surface treating agent (5) of Reference Example 5 at 40° C. for 1 minute under ultrasonic waves and then washed with deionized water for 1 minute. The plates were then immersed in 10% (w/v) aqueous potassium hydroxide solution serving as a pre-treating agent used before a corrosion inhibition treatment at 60° C. for 10 minutes under ultrasonic waves and then washed with deionized water for 1 minute. The plates were then immersed in cleaning agent (1) of Reference Example 9 at 50° C. for 5 minutes under ultrasonic waves and then washed with water. Thereafter, the plates were immersed in corrosion inhibitor (2) of Reference Example 7 at 40° C. for 1 minute and dried to obtain test pieces (13).

EXAMPLE 14

The procedure was conducted in the same manner as in Example 13 except that corrosion inhibitor (3) of Reference Example 8 was used in place of corrosion inhibitor (2) of Reference Example 7 to obtain test pieces (14).

EXAMPLE 15

The procedure was conducted in the same manner as in Example 13 except that, as pre-treating agent used before a corrosion inhibition treatment, 25% (w/v) aqueous tetramethylammonium hydroxide solution was used in place of 10% (w/v) aqueous potassium hydroxide solution to obtain test pieces (15).

Comparative Example 1

Molded plates were immersed in 5% (w/v) aqueous sodium monohydrogenphosphate solution at 50 to 70° C. for 5 minutes and then washed with water for 1 minute. The plates were then immersed in 10% (w/v) aqueous potassium hydroxide solution at 60° C. for 15 minutes and then washed with water for 1 minute. Thereafter, the plates were subjected to Manganese-treatment. The plates were washed with water and dried to obtain comparative test pieces (1).

Comparative Example 2

Molded plates were immersed in the surface treating agent (1) of Reference Example 1 at 40° C. for 10 minutes and then washed with deionized water for 1 minute. Thereafter, the plates were subjected to Manganese-treatment. The plates were washed with water and dried to obtain comparative test pieces (2).

Comparative Example 3

Molded plates were immersed in 10% (w/v) aqueous potassium hydroxide solution at 60° C. for 15 minutes and then washed with deionized water for 1 minute. The plates were then immersed in cleaning agent (1) of Reference Example 9 at 50° C. for 15 minutes and then washed with water. The plates were then immersed in corrosion inhibitor (1) of Reference Example 6 at room temperature for 1 minute and dried to obtain comparative test pieces (3).

Comparative Example 4

Molded plates were immersed in the surface treating agent (2) of Reference Example 2 at 40° C. for 1 minute under ultrasonic waves and then washed with deionized water for 1 minute. Thereafter, the plates were immersed in corrosion inhibitor (2) of Reference Example 7 at 40° C. for 1 minute under ultrasonic waves and dried to obtain comparative test pieces (4).

Comparative Example 5

Molded plates were immersed in 10% (w/v) aqueous potassium hydroxide solution at 60° C. for 5 minutes under ultrasonic waves and then washed with deionized water for 1 minute. The plates were then immersed in corrosion inhibitor (2) of Reference Example 7 at 40° C. for 1 minute under ultrasonic waves and dried to obtain comparative test pieces (5).

Comparative Example 6

Molded plates were immersed in 100 parts of aqueous solution containing 5 parts of sodium monohydrogenphosphate, 1 part of m-toluic acid, 1 part of 1,2,4-triazole, 2 parts of isopropanolamine and balance of water at 40° C. for 1 minute under ultrasonic waves and then washed with deionized water for 1 minute. The plates were then immersed in 10% (w/v) aqueous potassium hydroxide solution at 60° C. for 5 minutes under ultrasonic waves and then washed with deionized water for 1 minute. Thereafter, the plates were immersed in corrosion inhibitor (2) of Reference Example 7 at 40° C. for 1 minute under ultrasonic waves and dried to obtain comparative test pieces (6).

Test Example 1

(Salt Spray Test)

5% (w/v) Aqueous solution of sodium chloride was sprayed at 35° C. for 8 hours onto the test pieces obtained in Examples 1 to 15 and Comparative Examples 1 to 6, and the test pieces were checked for corrosion. Table 1 shows the result.

○ Corrosion appears on 0 to 3% of surface area of test pieces

Δ Corrosion appears on 3 to 11% of surface area of test pieces

X Corrosion appears on more than 11% of surface area of test pieces

Test Example 2

Resistivity Test

The resistance value of each test piece was measured at desired five points (triplicate) on its surface by a two-probe system (probe: Mitsubishi Chemical Corporation, Loresta MP) using contact resistance meter, Loresta MP (product of Dia Instruments Co., Ltd.). The test was conducted before and after the salt spray test of Test Example 1.

Before salt spray test

○ resistance value is up to 0.6Ω

X resistance value is more than 0.6Ω

After salt spray test

○ resistance value is up to 1.0Ω

X resistance value is more than 1.0Ω

Table 1 shows the result.

TABLE 1

| | | Test Example 2 | |
|---|---|---|---|
| | Test Example 1 Salt spray test | Before salt spray test | After salt spray test |
| test pieces 1 | ○ | ○ | ○ |
| test pieces 2 | ○ | ○ | ○ |
| test pieces 3 | ○ | ○ | ○ |
| test pieces 4 | ○ | ○ | ○ |
| test pieces 5 | ○ | ○ | ○ |
| test pieces 6 | ○ | ○ | ○ |
| test pieces 7 | ○ | ○ | ○ |
| test pieces 8 | ○ | ○ | ○ |
| test pieces 9 | ○ | ○ | ○ |
| test pieces 10 | ○ | ○ | ○ |
| test pieces 11 | ○ | ○ | ○ |
| test pieces 12 | ○ | ○ | ○ |
| test pieces 13 | ○ | ○ | ○ |
| test pieces 14 | ○ | ○ | ○ |
| test pieces 15 | ○ | ○ | ○ |
| Comparative test pieces 1 | ○ | X | X |
| Comparative test pieces 2 | Δ | ○ | X |
| Comparative test pieces 3 | Δ | ○ | X |
| Comparative test pieces 4 | Δ | ○ | X |
| Comparative test pieces 5 | X | X | X |
| Comparative test pieces 6 | ○ | X | X |

Test Example 3

Initial Adhesion Test

Each of the test pieces obtained in Example 2 and Comparative Examples 10 to 13 was coated with a metallic satin powder coating composition by a coater (product of Nihon Parkerizing Co., Ltd.) and baked (200° C. for 15 minutes) to prepare test pieces. Test pieces were subjected to a cross-cut test. Table 2 shows the results.

TABLE 2

| | Initial adhesion test Cross-cut test |
|---|---|
| test pieces 2 | 100/100 |
| test pieces 10 | 100/100 |
| test pieces 11 | 100/100 |
| test pieces 12 | 100/100 |
| test pieces 13 | 100/100 |

Test Example 4

Secondary Adhesion Test

Cross-cuts were made in test pieces (2) and (10), and a 5% aqueous solution of sodium chloride was sprayed onto the test pieces continuously at 35° C. for 120 hours. An adhesive tape (18 mm in width) was completely adhered to each test piece along the cut portion and thereafter peeled off instantaneously. The test pieces was then checked for the separation of the coating.

The state of the test piece having its coating peeled off was evaluated according to the scores prescribed in the X-cut Tape Method (JIS K 5400 8.5.3). Table 3 shows the result.

TABLE 3

| | Secondary adhesion test | |
|---|---|---|
| | Score of separation state | width of separation |
| test pieces 2 | 10 | 0 mm |
| test pieces 10 | 10 | 0 mm |

INDUSTRIAL APPLICABILITY

According to the present invention, it is possible to prepare magnesium and/or magnesium alloy component which is excellent in corrosion resistance, coating adhesiveness and property of shielding electromagnetic waves.

In the present invention, further investigation was conducted to obtain more excellent corrosion resistance, coating adhesiveness and property of shielding electromagnetic waves, and as the result, it is found that effects in corrosion, coating and plating are greatly enhanced by using a pre-treating agent used before a corrosion inhibition treatment after treating moldings of magnesium and/or magnesium alloys with a surface treating agent containing a phosphate, or at least one compound selected from among aromatic carboxylic acids and salts thereof, and further as required at least one compound selected from among pyrazole compounds and triazole compounds, together with the phosphate.

What is claimed is:

1. A process for preparing a treated magnesium and/or magnesium alloy component comprising:

(A) treating the magnesium and/or magnesium alloy component with a surface treating agent containing at least one compound selected from ammonium salts or alkanolamine salts of phosphoric acids as a phosphate, and thereafter (B) treating the component with a pre-treating agent selected from the group consisting of alkanolamines, aliphatic amines, aliphatic diamines, ammonium salts, cyclic amines, ammonia, hydrazine, alkali metal hydroxides, alkali metal salts of silicic acid and mixtures thereof; used before a corrosion inhibition treatment.

2. A process for preparing a treated magnesium and/or magnesium alloy component comprising (A) treating the magnesium and/or magnesium alloy component with a surface treating agent containing at least one compound selected from ammonium salts or alkanolamine salts of phosphoric acids as a phosphate, (B) treating the component with a pre-treating agent selected from the group consisting of alkanolamines, aliphatic amines, aliphatic diamines, ammonium salts, cyclic amines, ammonia, hydrazine, alkali metal hydroxides, alkali metal salts of silicic acid and mixtures thereof; used before a corrosion inhibition treatment, and thereafter (D) treating the component with a corrosion inhibitor for magnesium selected from the group consisting of manganese phosphate, potassium permanganate, ferric nitrate, stannic acid, zirconium phosphate, stannous chloride, aromatic carboxylic acids salts of aromatic carboxylic acids, and mixtures thereof.

3. A process for preparing a treated magnesium and/or magnesium alloy component comprising (A) treating the magnesium and/or magnesium alloy component with a surface treating agent containing at least one compound selected from ammonium salts or alkanolamine salts of phosphoric acids as a phosphate, (B) treating the component with a pre-treating agent used before a corrosion inhibition treatment, (C) treating the component with a cleaning agent containing surfactant and at least one compound selected from among aromatic carboxylic acids and salts thereof, and thereafter (D) treating the component with a corrosion inhibitor for magnesium.

4. A process as defined in claim 1 wherein as the treating agent (A) is used an agent containing the phosphate and at least one compound selected from among aromatic carboxylic acids and salts thereof, and further as required at least one compound selected from among pyrazole compounds and triazole compounds.

5. A process as defined in claim 2 wherein as the corrosion inhibitor for magnesium (D) is used an agent containing at least one compound selected from among aromatic carboxylic acids and salts thereof.

6. A process as defined in claim 2 wherein as the corrosion inhibitor for magnesium (D) is used an agent containing at least one compound selected from among aromatic carboxylic acids and salts thereof, and at least one compound selected from among pyrazole compounds and triazole compounds.

7. A process as defined in claim 3 wherein as the cleaning agent (C) is used an agent containing surfactant, at least one compound selected from among aromatic carboxylic acids and salts thereof, and at least one compound selected from among pyrazole compounds and triazole compounds.

8. A process as defined in claim 1 wherein at least one step of (A) and (B) is conducted under ultrasonic wave.

9. A process as defined in claim 1 wherein washing with water is added in a next step of each of at least one step of (A) and (B).

10. A process as defined in claim 3 wherein the pre-treating agent used before a corrosion inhibition treatment is at least one compound selected among alkali metal hydroxide and tetraalkylammonium hydroxide.

11.) A process as defined in claim 1 wherein the phosphate is an ammonium salt of a condensed phosphoric acid.

12. A process as defined in claim 3 wherein the aromatic carboxylic acid and salt thereof is cuminic acid, o-cuminic acid, m-cuminic acid, p-tert-butylbenzoic acid, o-toluic acid, m-toluic acid, p-toluic acid, or an alkanolamine salt of these acids.

13. A process as defined in claim 1 wherein the pre-treating agent used before a corrosion inhibition treatment is at least one compound selected from among alkali metal hydroxide and tetraalkylammonium hydroxide.

14. A process as defined in claim 4 wherein the triazole compound is 1,2,3 triazole, 1,2,4-triazole or 3-mercaoto-1, 2,4-triazole.

15. A process for preparing a treated magnesium and/or magnesium alloy component comprising (1) deburring the magnesium and/or magnesium alloy component when required, (2) treating the component with a surface treating agent containing at least one compound selected among ammonium salts or alkanolamine salts of phosphoric acids as a phosphate, (3) treating the component with a pre-treating agent used before a corrosion inhibition treatment, (4) treating the component with a corrosion inhibitor for magnesium, (5) drying the component, (6) coating or plating the component, and (7) thereafter assembling the component.

16. A process for preparing a treated magnesium and/or magnesium alloy component comprising (1) deburring the magnesium and/or magnesium alloy component when required, (2) treating the component with a surface treating agent containing at least one compound selected among ammonium salts or alkanolamine salts of phosphoric acids as a phosphate, (2-1) washing the component with water, (3) treating the component with a pre-treating agent used before a corrosion inhibition treatment, (3-1) washing the component with water, (4) treating the component with a corrosion inhibitor for magnesium, (4-1) washing the component with water as required, (5) drying the component, (6) coating or plating the component, and (7) thereafter assembling the component.

17. A process for preparing a treated magnesium and/or magnesium alloy component comprising (1) deburring the magnesium and/or magnesium alloy component when required, (2) treating the component with a surface treating agent containing at least one compound selected among ammonium salts or alkanolamine salts of phosphoric acids as a phosphate, (2-1) washing the component with water, (3) treating the component with a pre-treating agent used before a corrosion inhibition treatment, (3-2) washing the component with a cleaning agent containing surfactant and at least one compound selected from among aromatic carboxylic acids and salts thereof, (4) treating the component with a corrosion inhibitor for magnesium, (4-1) washing the component with water, (5) drying the component, (6) coating or plating the component, and (7) thereafter assembling the component.

18. A process as defined in claim 2 wherein as the treating agent (A) is used an agent containing the phosphate and at least one compound selected from among aromatic carboxylic acids and salts thereof, and further as required at least one compound selected from among pyrazole compounds and triazole compounds.

19. A process as defined in claim 3 wherein as the treating agent (A) is used an agent containing the phosphate and at least one compound selected from among aromatic carboxylic acids and salts thereof, and further as required at least one compound selected from among pyrazole compounds and triazole compounds.

20. A process as defined in claim 3 wherein as the corrosion inhibitor for magnesium (D) is used an agent containing at least one compound selected from among aromatic carboxylic acids and salts thereof.

21. A process as defined in claim 3 wherein as the corrosion inhibitor for magnesium (D) is used an agent containing at least one compound selected from among aromatic carboxylic acids and salts thereof, and at least one compound selected from among pyrazole compounds and triazole compounds.

22. A process as defined in claim 2 wherein at least one step of (A), (B) and (D) is conducted under ultrasonic wave.

23. A process as defined in claim 3 wherein at least one step of (A), (B), (C) and (D) is conducted under ultrasonic wave.

24. A process as defined in claim 2 wherein washing with water is added in a next step of each of at least one step of (A), (B) and (D).

25. A process as defined in claim 3 wherein washing with water is added in a next step of each of at least one step of (A), (B), (C) and (D).

26. A process as defined in claim 2 wherein the phosphate is an ammonium salt of a condensed phosphoric acid.

27. A process as defined in claim 3 wherein the phosphate is an ammonium salt of a condensed phosphoric acid.

28. A process as defined in claim 2 wherein the pre-treating agent used before a corrosion inhibition treatment is at least one compound selected among alkali metal hydroxide and tetraalkylammonium hydroxide.

* * * * *